US009217231B2

(12) United States Patent
Briski et al.

(10) Patent No.: US 9,217,231 B2
(45) Date of Patent: Dec. 22, 2015

(54) OBJECT-ENCLOSING CHAMBERED SCOOPER

(71) Applicant: Pioneer Pet Products, LLC, Cedarburg, WI (US)

(72) Inventors: Mark J. Briski, Mequon, WI (US); Jonathan D. Supanich, Cedarburg, WI (US); John M. Lipscomb, Cedarburg, WI (US)

(73) Assignee: Pioneer Pet Products, LLC, Cedarburg, WI (US)

( * ) Notice: Subject to any disclaimer, the term of this patent is extended or adjusted under 35 U.S.C. 154(b) by 0 days.

(21) Appl. No.: 14/457,106

(22) Filed: Aug. 11, 2014

(65) Prior Publication Data

US 2015/0042112 A1 Feb. 12, 2015

Related U.S. Application Data

(60) Provisional application No. 61/864,519, filed on Aug. 9, 2013.

(51) Int. Cl.
*A01K 29/00* (2006.01)
*E01H 1/12* (2006.01)

(52) U.S. Cl.
CPC ..... *E01H 1/1206* (2013.01); *E01H 2001/1293* (2013.01)

(58) Field of Classification Search
CPC ..... E01H 1/1206; E01H 2001/1293
USPC ..... 294/1.3, 1.4, 1.5, 209, 115
See application file for complete search history.

(56) References Cited

U.S. PATENT DOCUMENTS

| | | | | | |
|---|---|---|---|---|---|
| 1,231,116 | A * | 6/1917 | Bender | 294/115 |
| 1,756,441 | A * | 4/1930 | Smith | 294/115 |
| 3,139,299 | A * | 6/1964 | Bowen | 294/1.4 |
| 3,738,697 | A * | 6/1973 | Kahan | 294/1.4 |
| 3,841,686 | A * | 10/1974 | Gallo et al. | 294/1.4 |
| 5,326,143 | A * | 7/1994 | Babler | 294/1.4 |
| 5,380,054 | A * | 1/1995 | Galvis | 294/1.4 |
| 5,503,442 | A * | 4/1996 | Lee | 294/1.4 |
| 7,281,740 | B1 * | 10/2007 | Fields | 294/100 |
| 2004/0066049 | A1 * | 4/2004 | Azrikam | 294/1.4 |
| 2008/0042456 | A1 * | 2/2008 | Patel | 294/1.3 |

FOREIGN PATENT DOCUMENTS

| | | | |
|---|---|---|---|
| DE | 29704534 | * | 5/1997 |
| GB | 2095156 | * | 9/1982 |

* cited by examiner

*Primary Examiner* — Dean Kramer
(74) *Attorney, Agent, or Firm* — Boyle Fredrickson S.C.

(57) ABSTRACT

A scooper that has a plurality of pivoting scoop jaws that rotate between an open position and a closed position defining a substantially enclosed object-holding scooper chamber that operably cooperates with a skirt overlying the scoop jaws covering a top of the chamber that also which protects scoop jaw pivoting linkages and pivots of the scooper. Such a scooper can be constructed with an elongate frame that can be tubular in which a scoop jaw actuating linkage arrangement is disposed enabling the scooper to be used while standing up. Such a scoop can also be configured to be stored uprightly and is well suited for a wide variety of indoor and outer scooping applications including for fecal matter scooping, trash or refuse pickup, object pickup and the like.

39 Claims, 12 Drawing Sheets

OBJECT-ENCLOSING CHAMBERED SCOOPER

CROSS REFERENCE

This application claims priority under 35 U.S.C. §119(e) to U.S. Provisional Patent Application No. 61/864,519, filed Aug. 9, 2013, the entirety of which is hereby incorporated by reference herein.

FIELD

The present invention is directed to a manually operated scooper and more particularly to a scooper with scoop jaws that form a chamber when closed that substantially completely encloses the object(s) scooped up.

BACKGROUND

Pets provide a great deal of joy and companionship to persons of all ages, including the elderly and infirm. No matter what the age, it has always been a challenge to dispose of fecal matter.

Many types of devices have been developed to enable a person to pick up and facilitate removal of many different types of objects without the person having to come into direct contact with the object. With an increasingly elderly population, attempts have been made to develop hand operated refuse pickup devices, typically referred to as "poop scoopers," "pooper scoopers," or the like, which employ a long enough handle to enable the user to scoop or pick up refuse while standing up.

While prior long handled refuse pickup devices have been designed for outdoor use, with an ever growing indoor pet population, a need has arisen for a long handled refuse pickup device that can not only be used outdoors but which is particularly well suited for indoor use. One such refuse pickup device capable of such dual use is the refuse or poop scooper disclosed in commonly owned U.S. Pat. No. 8,235,434, which has an elongate handle with a pair of relatively movable scoop jaws that are biased in an open position when not in use to enable the scooper to be stood uprightly on a flat surface in a convenient ready-to-use position.

While the scooper disclosed in U.S. Pat. No. 8,235,434 is an advancement over other prior art scoopers, improvements nonetheless remain desirable. What is needed is a long-handled refuse or poop scooper with scoop jaws used to scoop an object into a chamber formed by the closed jaws that is more sanitary than prior scoopers. What also is desired is a long-handled refuse or poop scooper that can be stood uprightly in a ready to use condition whether the scoop jaws are open or closed.

SUMMARY

The present invention is directed to a device for picking up one or more objects that preferably is a refuse pickup device well suited for use as a scooper, e.g., pooper scooper, having a pair of scoop jaws pivotally movable between an open position enabling scooping up of one or more objects and a closed position where the scoop jaws form an object-holding chamber that substantially completely encloses the scooped up objects. The scooper has a frame of hollow, tubular construction that can be formed of a tube of one-piece or two-piece construction defining a frame tube that provides a guide for a scoop jaw actuator linkage arrangement that facilitates scoop jaw movement between the open and closed positions.

The scoop jaws are each pivotally attached to a corresponding one of a pair of radially outwardly and downwardly extending scoop jaw pivot anchors that forms a cradle that supports the scoop jaws when the scoop jaws are closed. The scooper has a skirt that covers an opening formed between the scoop jaws through which scoop jaw links of the scoop jaw actuator linkage arrangement extends and protects the scoop jaw actuator linkage arrangement during scooper use and operation. The tubular frame of the scooper preferably is elongate having a length long enough to enable a user to operate the scooper while standing up. The scoop jaws have a generally flat bottom wall that form a base or pedestal upon which the scooper can be uprightly stood on the floor or ground when not being used.

DRAWING DESCRIPTION

One or more preferred exemplary embodiments of the invention are illustrated in the accompanying drawings in which like reference numerals represent like parts throughout and in which.

Figure 1:
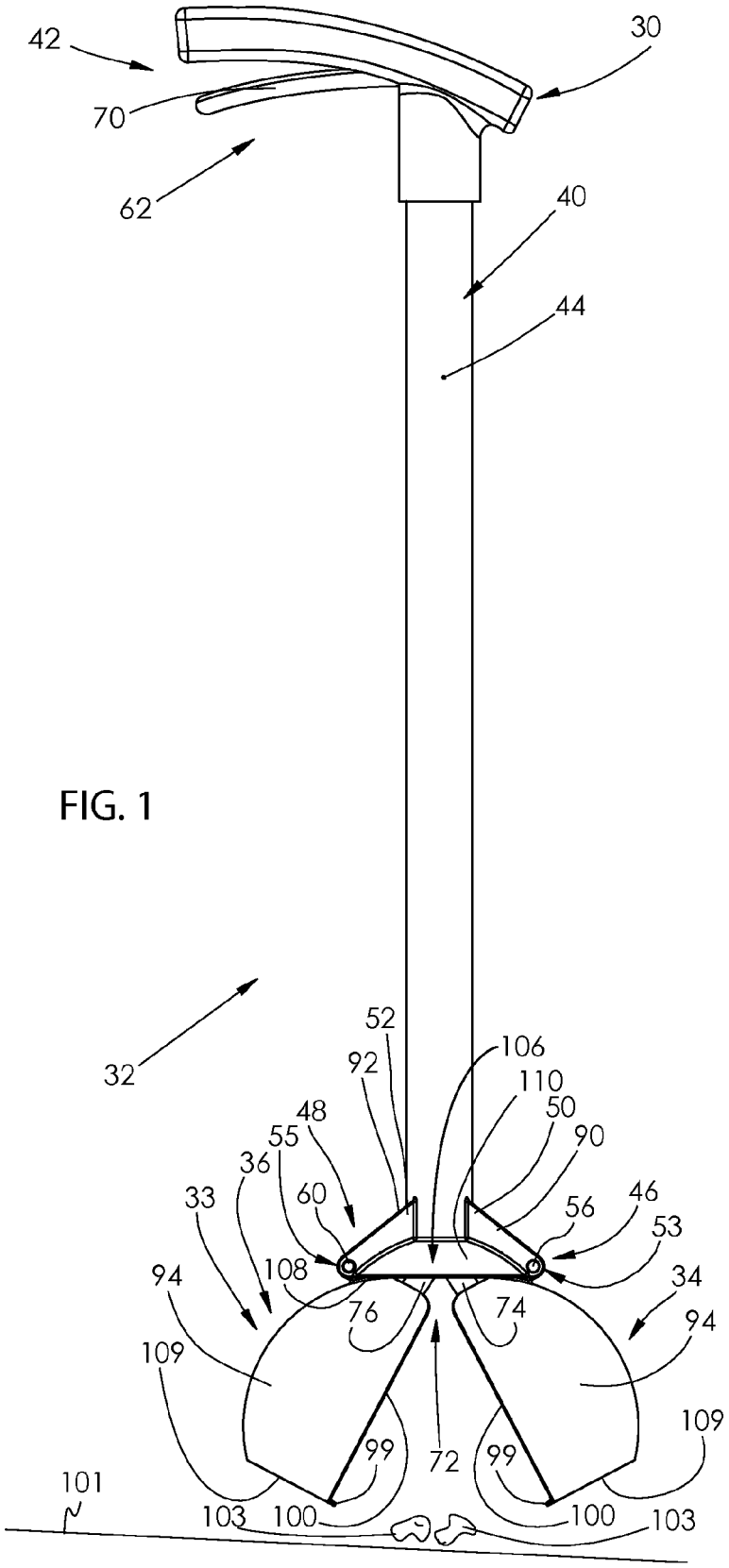
FIG. 1 is a side elevation view of a preferred embodiment of a scooper with the scoop jaws shown in an open position.

Before explaining one or more embodiments of the invention in detail, it is to be understood that the invention is not limited in its application to the details of construction and the arrangement of the components set forth in the following description and illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION

Figure 2:
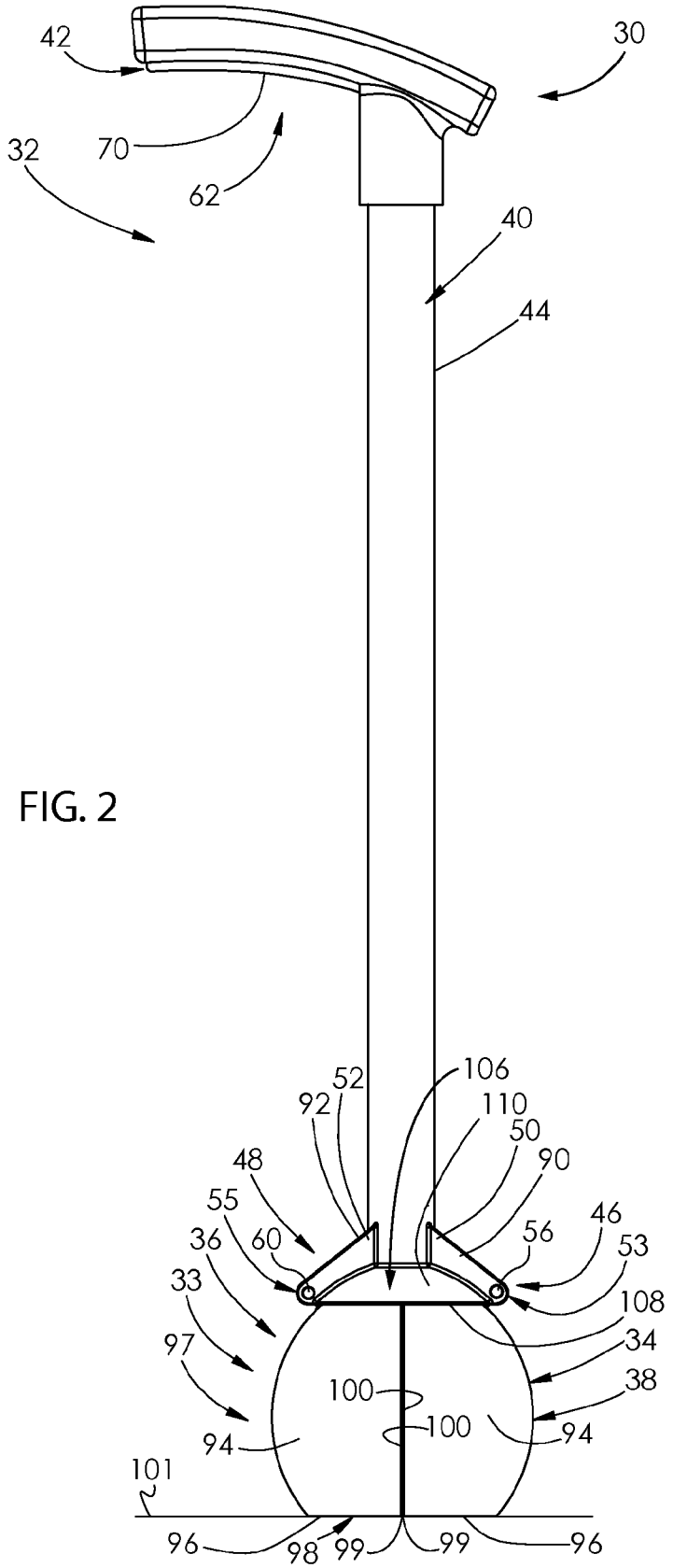
FIG. 2 is a side elevation view of the scooper of FIG. 1 with the scoop jaws shown in a closed position.
Figure 3:
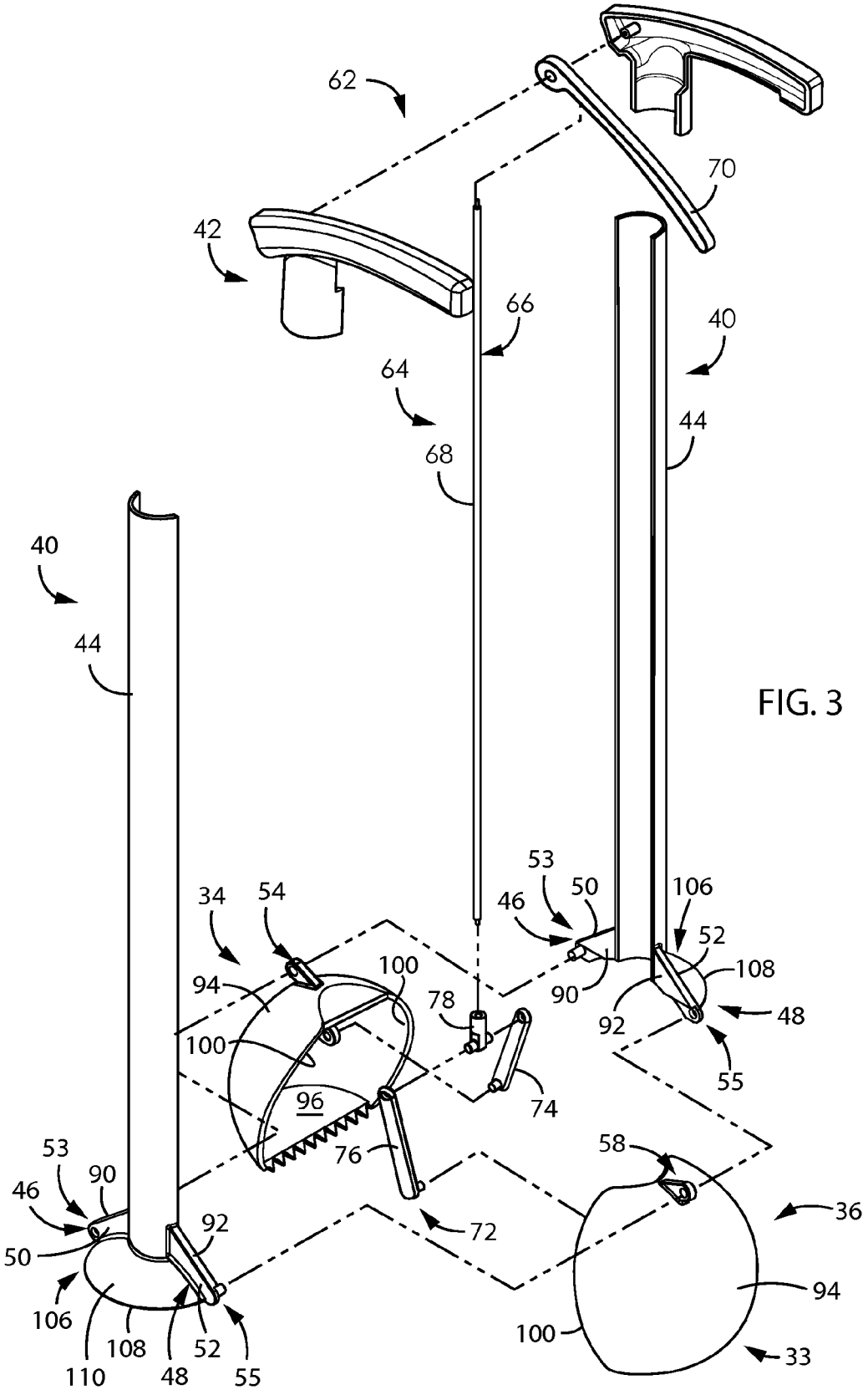
FIG. 3 is an exploded view of the scooper shown in FIG. 1.
Figure 4:
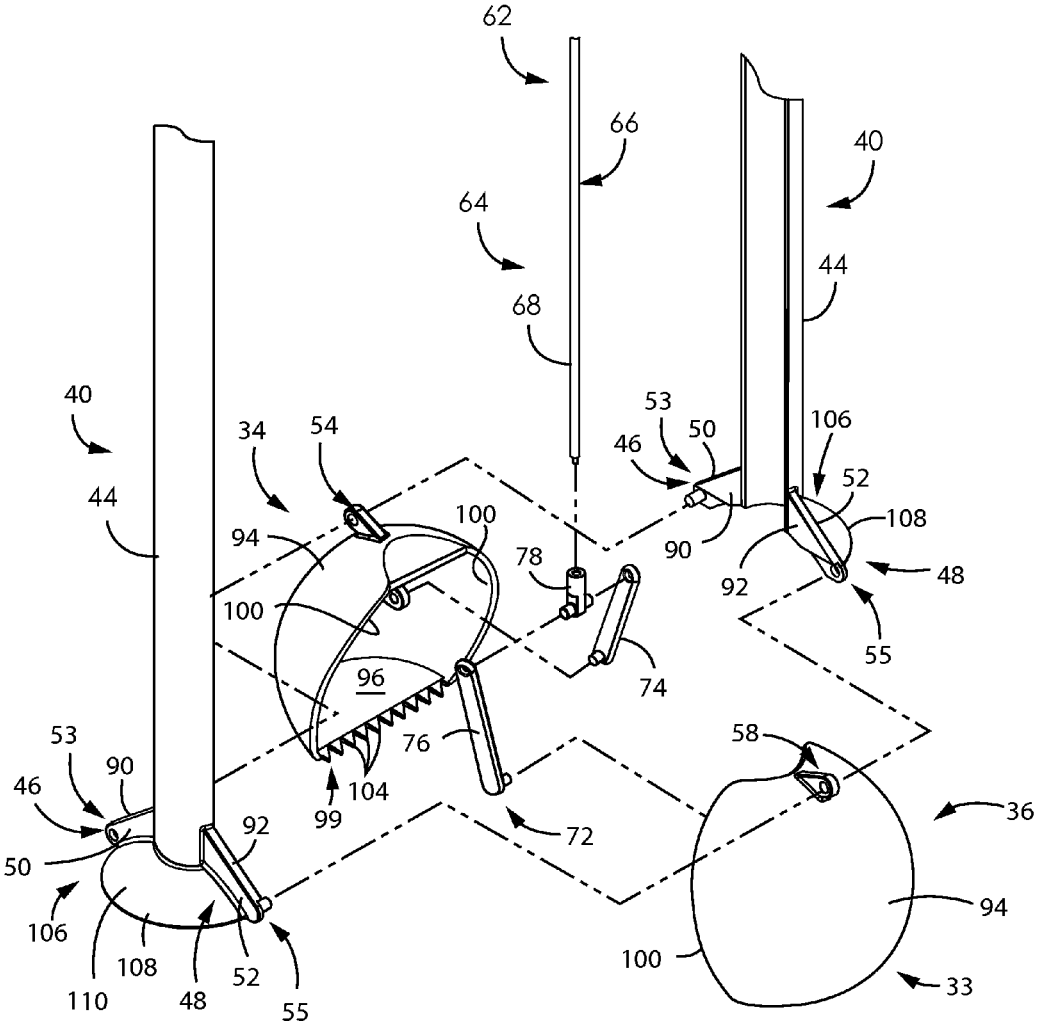
FIG. 4 is an enlarged exploded view of a scooper head of the scooper shown in FIG. 1.
Figure 5:
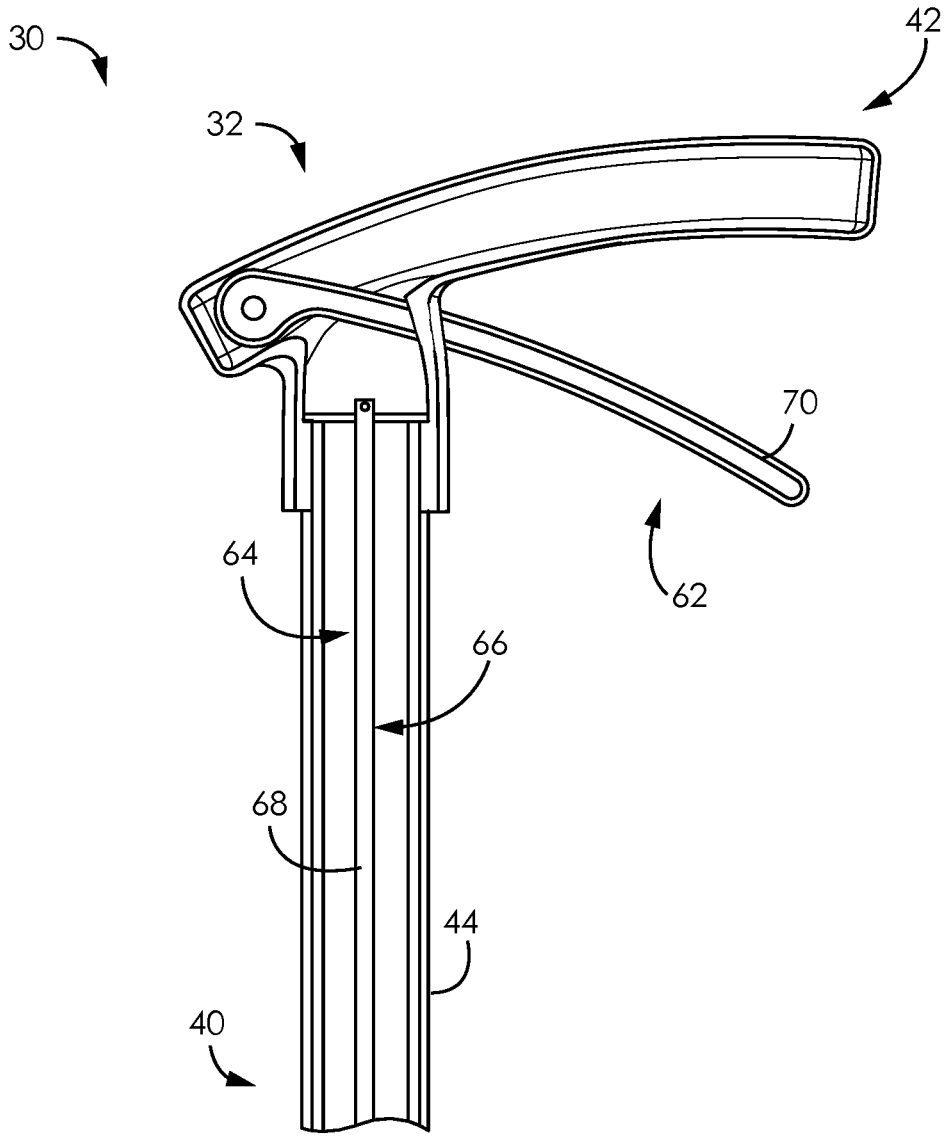
FIG. 5 is a fragmentary enlarged cross-sectional view of the handle and part of the frame of the scooper of FIG. 1.

FIGS. 1-10 illustrate one preferred but exemplary embodiment of a refuse pickup device 30, a scooper 32, having a scooper head 33 that includes a pair of scoop jaws 34, 36 with at least one of the jaws 34, 36 being movable relative to at least one other of the jaws 34, 36 between an open or scooping position, such as shown in FIG. 1, and a closed or object-retaining position, such as shown in FIG. 2, forming an object-retaining chamber 38 when the jaws 34, 36 are substantially closed that releasably retains one or more objects, such as refuse, fecal matter, trash and/or the like, in the chamber 38. The jaws 34, 36 are pivotally coupled to a frame 40 that has a handle 42 at an end of the frame 40 opposite the jaws 34, 36 that is manipulable by a user of the scooper 32 to enable one or preferably both of the jaws 34, 36 to be moved by the user between open and closed positions during use and operation of the scooper 32.

The scooper frame 40 is elongate and can be formed of a tube 44 having the handle 42 disposed at one end and a scoop jaw mount 46 disposed at an opposite end with the scoop jaws 34, 36 pivotally attached to the mount 46. The scoop jaw mount 46 forms part of a scoop jaw pivot joint arrangement 48 rotatively connecting or pivotally grounding the jaws 34, 36 to the frame 40 with the mount 46 having a pair of jaw pivot anchors 50, 52 that extend oppositely outwardly from the frame 40. One of the jaws 34 has a pivot joint mount 54 attached to one of the jaw pivot anchors 50 via a first pivot 56, e.g., a pivot pin, and the other one of the jaws 34 has a pivot joint mount 58 attached to the other one of the jaw pivot anchors 52 via a second pivot 60, e.g., another pivot pin respectively forming a pair of outer scoop jaw pivot joints 53, 55. Such a scoop jaw pivot joint arrangement 48 enables each one of the jaws 34, 36 to rotate about its respective pivot 56, 60 outwardly away from the other one of the jaws 36, 34 from the closed position, shown in FIG. 2, towards an open position, such as the open position shown in FIG. 1.

The scooper 32 has a scoop jaw actuator assembly 62 that includes an elongate scoop jaw actuator connector 64 that preferably is an elongate connecting link 66, such as an elongate substantially rigid connecting rod 68, which is slidably telescopically received in the scooper frame tube 44 and operatively connected to the handle 42 and scoop jaws 34, 36. As is best shown in FIGS. 3-9, the scoop jaw actuator connector 64 is operatively connected at or adjacent one end to a trigger 70 pivotally carried by the handle 42 and operatively connected at or adjacent its opposite end by a scoop jaw actuator linkage arrangement 72 to at least one of the scoop jaws 34, 36 and preferably both of the jaws 34, 36. The scoop jaw actuator linkage arrangement 72 includes a pair of scoop jaw actuator links 74, 76 each pivotally attached at one end to a pivot joint coupling 78 mounted to the scoop jaw actuator connector 64 and each pivotally attached at an opposite end to a corresponding one of the scoop jaws 34, 36.

Figure 7:
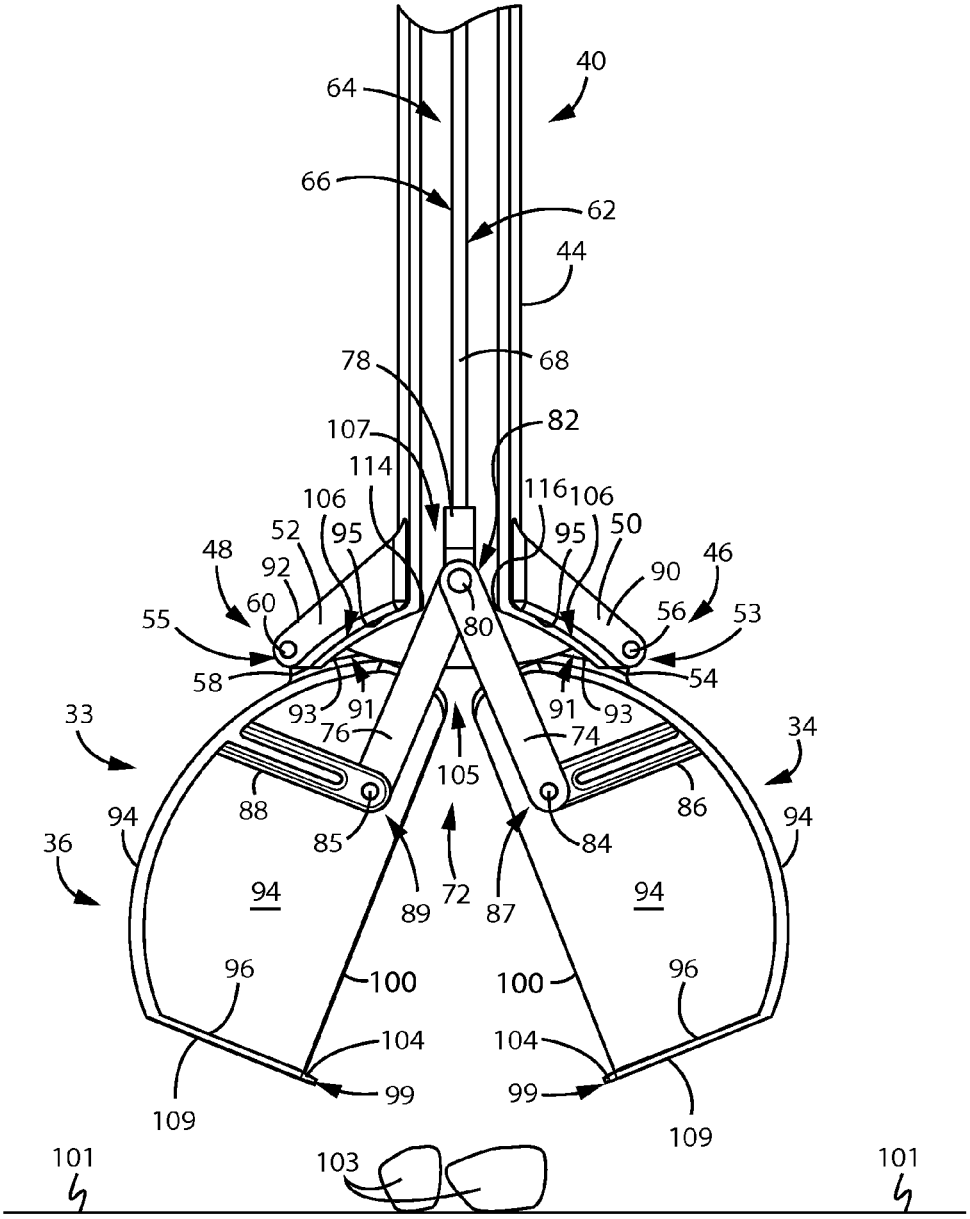
FIG. 7 is a fragmentary enlarged cross-sectional view of the scoop head with the scoop jaws in an open position.
Figure 9:
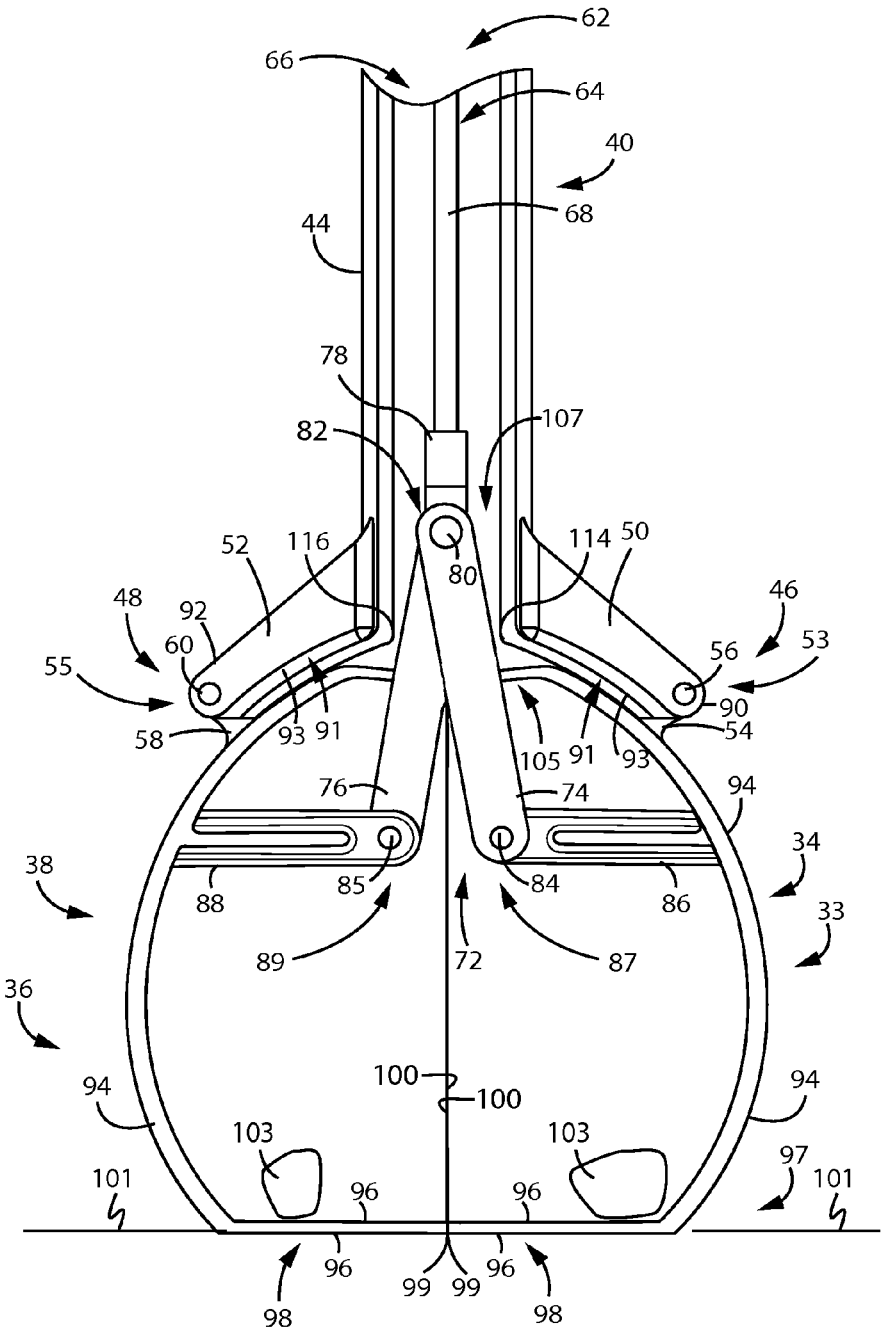
FIG. 9 is a fragmentary enlarged cross-sectional view of the scooper head with the scoop jaws in the closed position.
Figure 10:
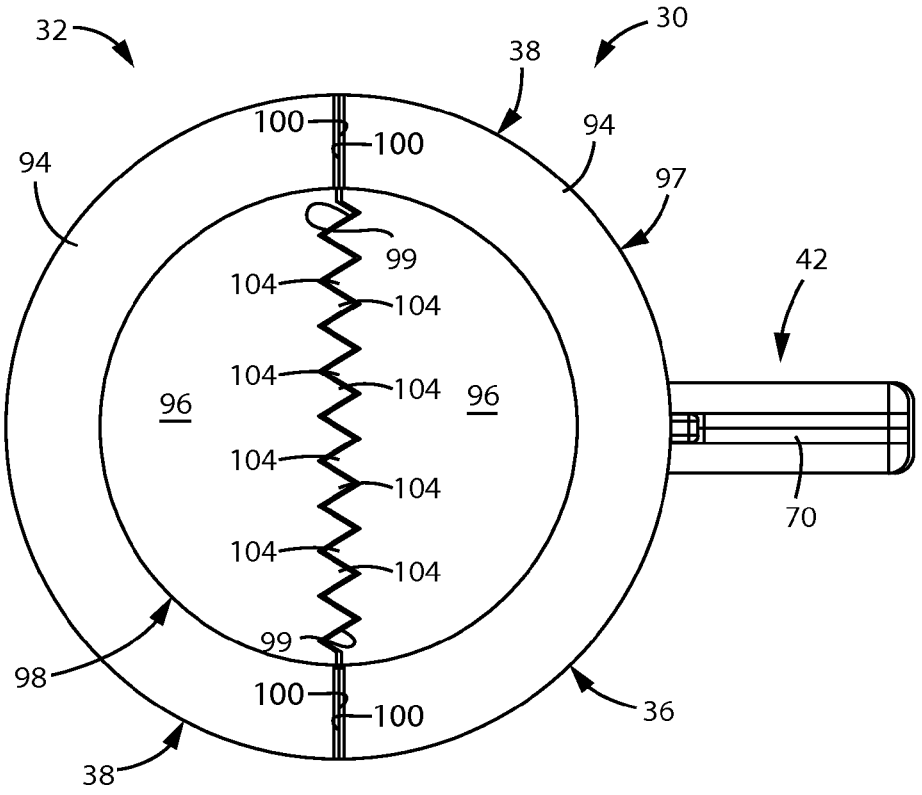
FIG. 10 is a bottom plan view of the scooper with the scoop jaws in the closed position.

As is best shown in FIGS. 7 and 9, each one of the scoop jaw actuator links 74, 76 are pivotally attached at or adjacent one end by a common pivot 80 to the coupling 78 forming an in-frame pivot joint 82 therewith disposed within the frame 40 upwardly or upstream of the scoop jaws 34, 36. As is also shown in FIGS. 7 and 9, each one of the links 74, 76 are attached at or adjacent an opposite end by a corresponding pivot 84, 85 to a respective one of the jaws 34, 36 forming in-jaw scoop jaw pivot joints 87, 89. Each one of the links 74, 76 is pivotally attached by respective pivot 84, 85 to a corresponding one of a pair of scoop jaw pivot joint arms 86, 88 projecting outwardly from within a respective scoop jaw 34, 36.

With continued reference to FIGS. 7 and 9, each one of the scoop jaw pivot anchors 50, 52 attached to the frame 40 is formed by a corresponding one of a pair of elongate scoop jaw pivot anchor arms 90, 92 that extend generally radially outwardly from the frame tube 44 generally in a direction opposite one another. Each one of the scoop jaw pivot anchor arms 90, 92 is angled downwardly toward the corresponding scoop jaw 34, 36 to which the scoop jaw pivot anchor arm 90, 92 is pivotally connected. Each scoop jaw pivot anchor arm 90, 92 is downwardly angled in a manner such that a free end of each scoop jaw pivot anchor arm 90, 92 extends axially outwardly beyond the axial end of the frame 40. Each scoop jaw pivot anchor arm 90, 92 is downwardly angled in a manner that forms an obtuse angle with a longitudinal axis of the frame 40, i.e., longitudinally extending centerline of the frame tube 44 along which the connector link 66 generally extends. As is also shown in FIGS. 7 and 9, the scoop jaw pivot anchor arms 90, 92 also form an obtuse included angle with one another and can form an acute included angle with one another if desired.

As is further depicted in FIGS. 7 and 9, each one of the scoop jaw pivot anchor arms 90, 92 can be and preferably is inclined or curved about an adjacent portion of the corresponding scoop jaw 34, 36 to which the respective scoop jaw pivot anchor arm 90, 92 is pivotally connected defining a scoop jaw cradle 91 against which part of a corresponding scoop jaw 34, 36 can be and preferably is supported when the jaws 34, 36 are closed to help keep the jaws 34, 36 closed. Where inclined or curved, each one of the scoop jaw pivot anchor arms 90, 92 generally conforms to at least a portion of the corresponding scoop jaw 34, 36 to which the respective scoop jaw pivot anchor arm 90, 92 is pivotally connected that also can be curved.

Each scoop jaw pivot anchor arm 90, 92 has a shoulder 93 facing a corresponding one of the scoop jaws 34, 36 defining a cradle 91 that not only supports each jaw 34, 36 when the jaws 34, 36 are closed but which also provides a stop or an abutment 95 against which an adjacent portion of a respective jaw 34, 36 stops during jaw closure to help keep the jaws 34, 36 closed. By each shoulder 93 of each scoop jaw pivot anchor arm 90, 92 serving as a stop or abutment 95 against which part of each jaw 34, 36 stops when closed, each scoop jaw pivot anchor arm 90, 92 supports the object-enclosing chamber 38 formed by the closed jaws 34, 36 advantageously helping to maintain the integrity of the chamber 38 when subjected to loading, stresses, strains, torsion, bending moments, and the like during scooper use and operation.

As is best shown in FIG. 9, the scoop jaws 34, 36 form an object-retaining chamber 38 of clamshell construction that substantially completely encloses each of one or more objects scooped up during scooper use and operation. Each one of the jaws 34, 36 has a convexly curved outer sidewall 94 connected to a bottom wall 96 defining an object-retaining chamber 38 that preferably is a bulbous or globular enclosure 97 that that can be generally spherical that completely encloses one or more objects 103 in the chamber 38 when the jaws 34, 36 are closed. The bottom wall 96 of each jaw 34, 36 has a leading edge 99 that can taper or neck down to, for example, a knife edge defining a ground-engaging scoop ramp 109 that facilitates scooping up of one or more objects 103 on the ground 101 during closing of the jaws 34, 36. To further facilitate scooping, including by enabling raking of the ground 101 next to one or more objects 103 being scooped up, the bottom wall outer edge 99 of each one of the jaws 34, 36 can have a plurality of pairs, i.e., at least three, teeth 104 formed therein that engage or intermesh with the teeth 104 formed in the bottom wall outer edge 99 of the other one of the jaws 34, 36 when the jaws 34, 36 are closed. Additionally, when the jaws 34, 36 are closed, the flat bottom wall 96 of each jaw 34, 36 adjoins or abuts one another forming a generally flat or planar pedestal or base 98 upon which the scooper 32 can be stood uprightly on a generally flat or planar surface 101, such as the ground, floor, etc., when the scooper 32 is not in use.

To provide an object-retaining chamber 38 possessing a larger retention volume that can substantially simultaneously hold a greater number of objects scooped up by the scooper 32 during use and operation, the sidewall 94 of each scoop jaw 34, 36 extends upwardly terminating at or adjacent the end of the frame 40 forming an opening 105 in communication with an opening 107 in the end of the frame 40 through which the jaw actuator links 74, 76 extend. As is best shown in FIGS. 6-9, the uppermost portion of the sidewall 94 of each jaw 34, 36 disposed adjacent the frame 40 is inclined or curved toward the frame 40 terminating adjacent the opening 107 in the end of the frame 40 through which the jaw actuator links 74, 76 extend maximizing scooper retention volume while minimizing loss of scooped up matter retained in the chamber 38 when the jaws 34, 36 are closed. While the links 74, 76 can be straight, the links 74, 76 can also be curved such as in the manner shown in FIGS. 11 and 12.

Whether the links 74, 76 are curved or straight, end of the frame 40 has an annular inner shoulder 114 that defines a link guide or cam 116 that causes each one of the scoop jaw links 74, 76 to rotate or pivot about pivot 80 of the in-frame disposed joint 82 toward the other one of the links 76, 74 facilitating closing of the scoop jaws 34, 36 when the trigger 70 is squeezed by a user seeking to close the jaws 34, 36. As the trigger 70 is squeezed, pivotable movement of the trigger 70 relative to the rest of the handle 42 slidably telescopically displaces the elongate scoop actuator connecting link 66 upwardly within the scooper frame tube 44 thereby also pulling the pivot joint coupling 78 upwardly within the tube 44 toward the handle 42. As the pivot joint coupling 78 is pulled upwardly, an outer edge of each scoop jaw link 74, 76 rides, e.g., is slidably guided, along the link guide or cam 116 formed by the shoulder 114 of the scooper frame tube 44 urging the scoop jaw links 74, 76 toward each other. As the scoop jaw links 74, 76 are urged toward one another, e.g., pinched together, by the opposite sides or opposite edges of the frame tube shoulder 114, the angle of the acute included angle between the links 74, 76 decreases causing each link 74, 76 to pull the scoop jaw 34, 36 to which the corresponding link 74, 76 is connected toward the other scoop jaw 34, 36.

When the scoop jaws 34, 36 are closed, the scooper frame tube 44 constrains relative pivotable movement of the scoop jaw links 74, 76 away from one another helping to securely retain the jaws 74, 76 in their closed position until the trigger 70 of the handle 42 is released. When released, biasing force tending to want to open the jaws 34, 36 displaces the elongate scoop actuator link 66 downwardly toward the end of the scooper frame tube 44 urging the pivot joint coupling 78 toward the end of the tube 44. As the pivot joint coupling 78 is urged toward the end of the tube 44, both scoop jaw links 74, 76 are further extended outwardly from the tube 44 causing the pivot angle and spacing between the links 74, 76 to increase thereby causing the jaws 34, 36 to rotate about their respective pivot 56, 60 opening the jaws 34, 36.

To prevent any portion of any object scooped up into the object-retaining chamber 38 from passing through or otherwise falling downwardly from of the chamber 38 when the scoop jaws 34, 36 are closed, the bottom wall outer edges 99 and outer sidewall edges 100 adjoin and preferably abut one another as depicted in FIGS. 2, 6, 8 and 9. Depending on the nature of contact between the bottom wall outer edges 99 and outer sidewall edges 100, closure of the jaws 34, 36 can and preferably does provide a seal therebetween forming an object-enclosing chamber 38 of substantially sealed construction that preferably prevents flow of granular material between the abutting scoop jaw edges 99 and 100 providing a seal therebetween that can even be liquid-tight if desired. Where the outer edge 99 of the bottom wall 96 of each scoop jaw 34, 36 is formed with spaced apart teeth 104, the teeth 104 of both jaws 34, 36 engage and enmesh one another when the jaws 34, 36 are closed in a manner that helps prevent any portion of any of the objects scooped up from passing through or otherwise falling out of the object-retaining chamber 38.

A scooper 32 made in accordance with the present invention having scoop jaws 34, 36 that form such an object-retaining chamber 38 of substantially completely enclosed construction when the jaws 34, 36 are closed advantageously produces a more sanitary scooper 32 because it minimizes and preferably substantially completely prevents loss of matter from the chamber 38. Where the jaws 34, 36 are of imperforate construction, such imperforate jaws 34, 36 form an object-retaining chamber 38 of substantially completely sealed construction produces an even more sanitary scooper 32 by minimizing and preferably substantially completely preventing disease transfer, insect infestation, parasitic outbreaks, and the like, particularly when the jaws 34, 36 are closed during storage.

To cover the opening 105 formed at the top of the object-retaining chamber 38 where the sidewall 100 of both scoop jaws 34, 36 terminate, a skirt 106 extends outwardly from the frame 40 and overlies at least a portion of the sidewall 100 of each jaw 34, 36 located adjacent the end of the frame 40. Such a skirt 106 extends outwardly and downwardly from the frame 40 toward the jaws 34, 36 having a generally circular outer peripheral edge 108 overlying both jaws 34, 36 forming a generally bowl-shaped skirt 106 that covers or enshrouds a generally spherically shaped top portion of the object-retaining chamber 38. Such a skirt 106 preferably also helps cover and protect the scoop jaw links 74, 76, the pivot joint coupling 78, and/or each one of the scoop jaw pivot joints 53, 55, 87 and 89.

Such a downwardly facing bowl-shaped skirt 106 is formed of a generally outwardly and downwardly extending conical, frustoconical or frustum shaped skirt sidewall 110 that can and preferably does extend from one scoop jaw pivot anchor arm 90 to the other scoop jaw pivot anchor arm 92. Where the scooper 32 includes such a skirt 106 that interconnects or extends between the scoop jaw pivot anchor arms 90, 92, the skirt 106 can form part of a cradle 91 that helps support the scoop jaws 34, 36 along substantially the entire surface area of both jaws 34, 36 that is covered or enshrouded by the skirt 106 when the jaws 34, 36 are closed. Where the scooper 32 includes such a skirt 106 that interconnects or extends between the scoop jaw pivot anchor arms 90, 92, the scoop jaw pivot anchor arms 90, 92 also function as stiffeners or stiffening ribs that help strengthen and structurally rigidify the frame 40 and the skirt 106.

Figure 6:
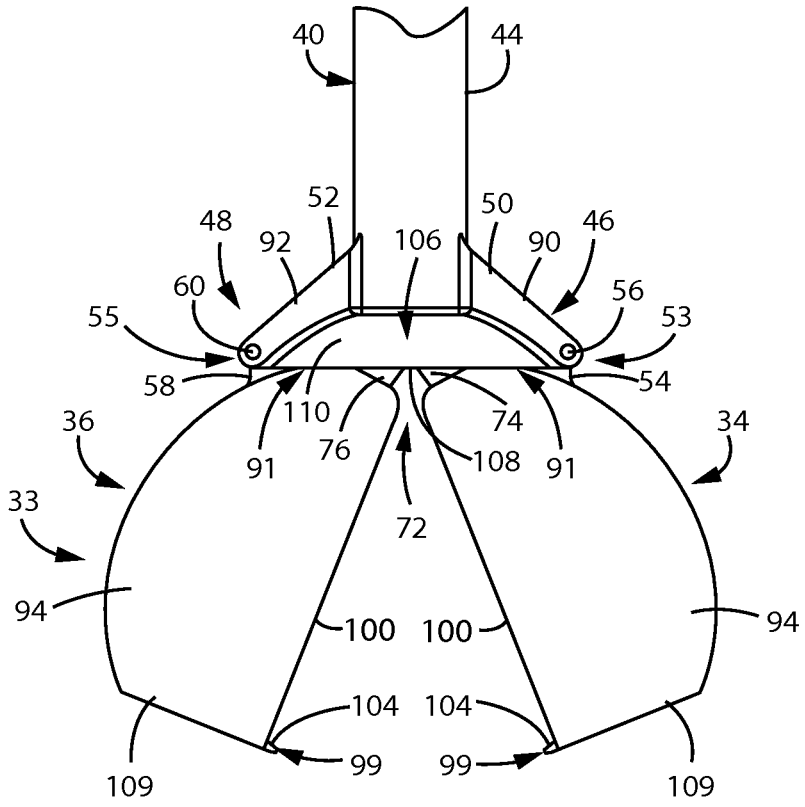
FIG. 6 is a fragmentary enlarged view of the scooper head with the scoop jaws in an open position.
Figure 8:
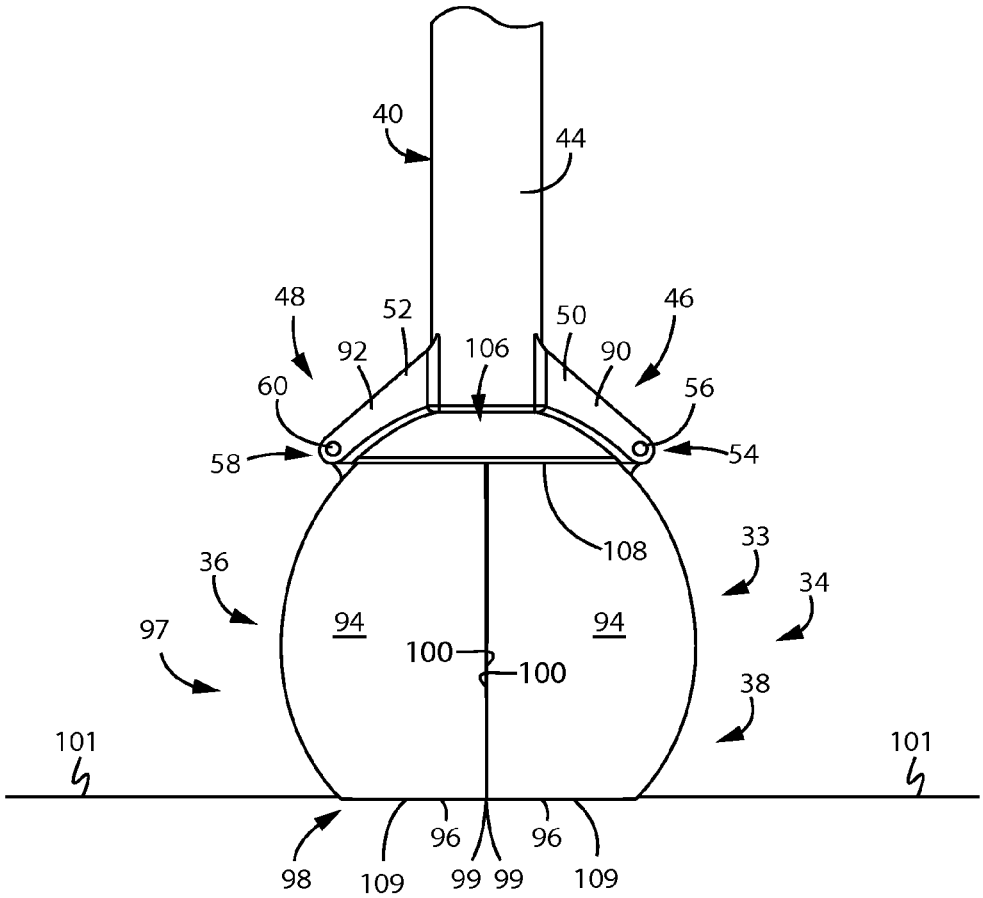
FIG. 8 is a fragmentary enlarged view of the scooper head with the scoop jaws in a closed position.

A scooper 32 constructed in accordance with the present invention can be resiliently urged or biased, such as by a biasing element or the like (not shown), e.g., spring, toward the closed position shown in FIGS. 2, 8 and 9, but preferably is biased toward an open position, such as the open positions shown in FIGS. 1, 6 and 7. Although not shown in FIGS. 1-10, the trigger 70 of the handle 42 can be resiliently biased toward the desired open or closed scoop jaw position by a spring, such as a torsion spring, a coil spring or the like. If desired, a coil spring captured in compression or disposed in tension could be grounded to the frame 40 and coupled to the trigger 70 and/or the actuating link 66 to urge or bias one or both scoop jaws 34, 36 to the desired open or closed position. Other suitable examples of one or more arrangements for resiliently urging or biasing one or both scoop jaws of a scooper toward either a desired open position or a desired closed position are disclosed in commonly owned U.S. Pat. No. 8,235,434, the entire disclosure of which is expressly incorporated herein by reference.

Figure 11:
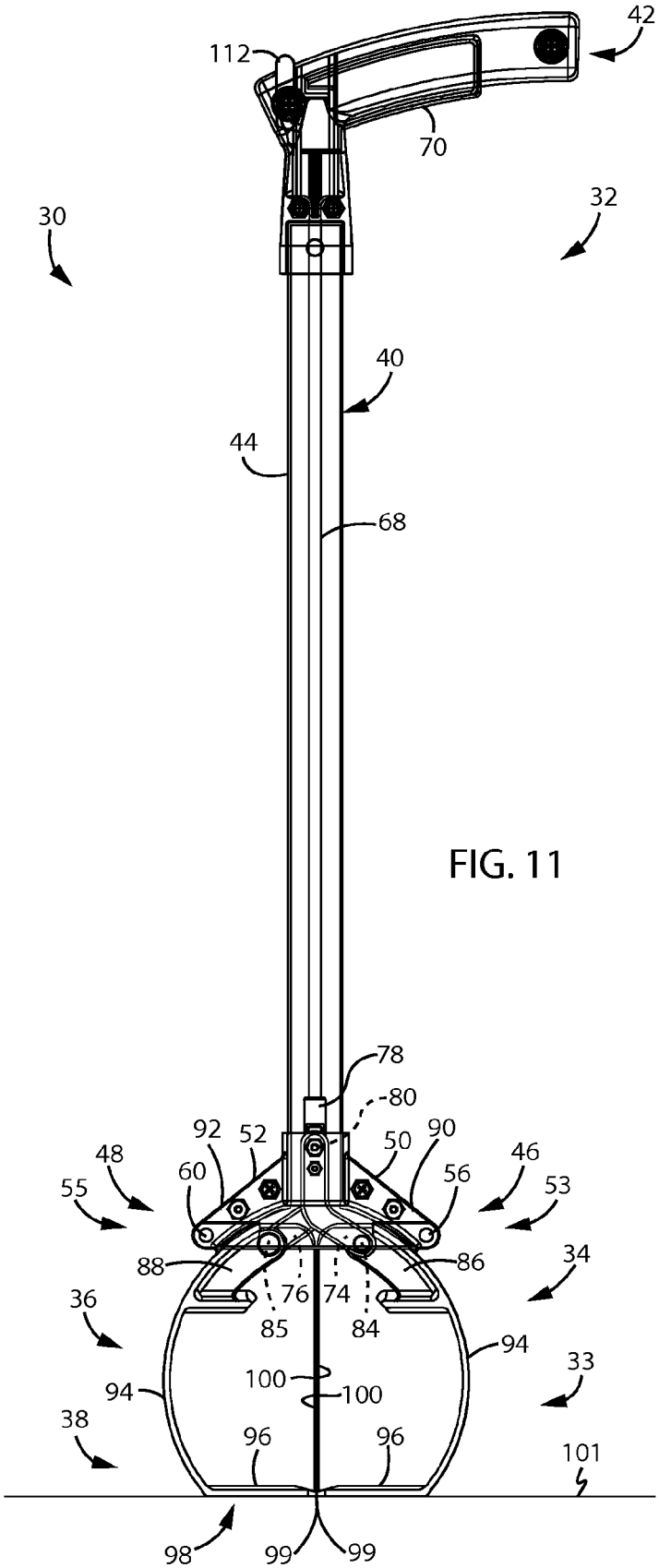
FIG. 11 is a side elevation view of a second preferred embodiment of a scooper.
Figure 12:
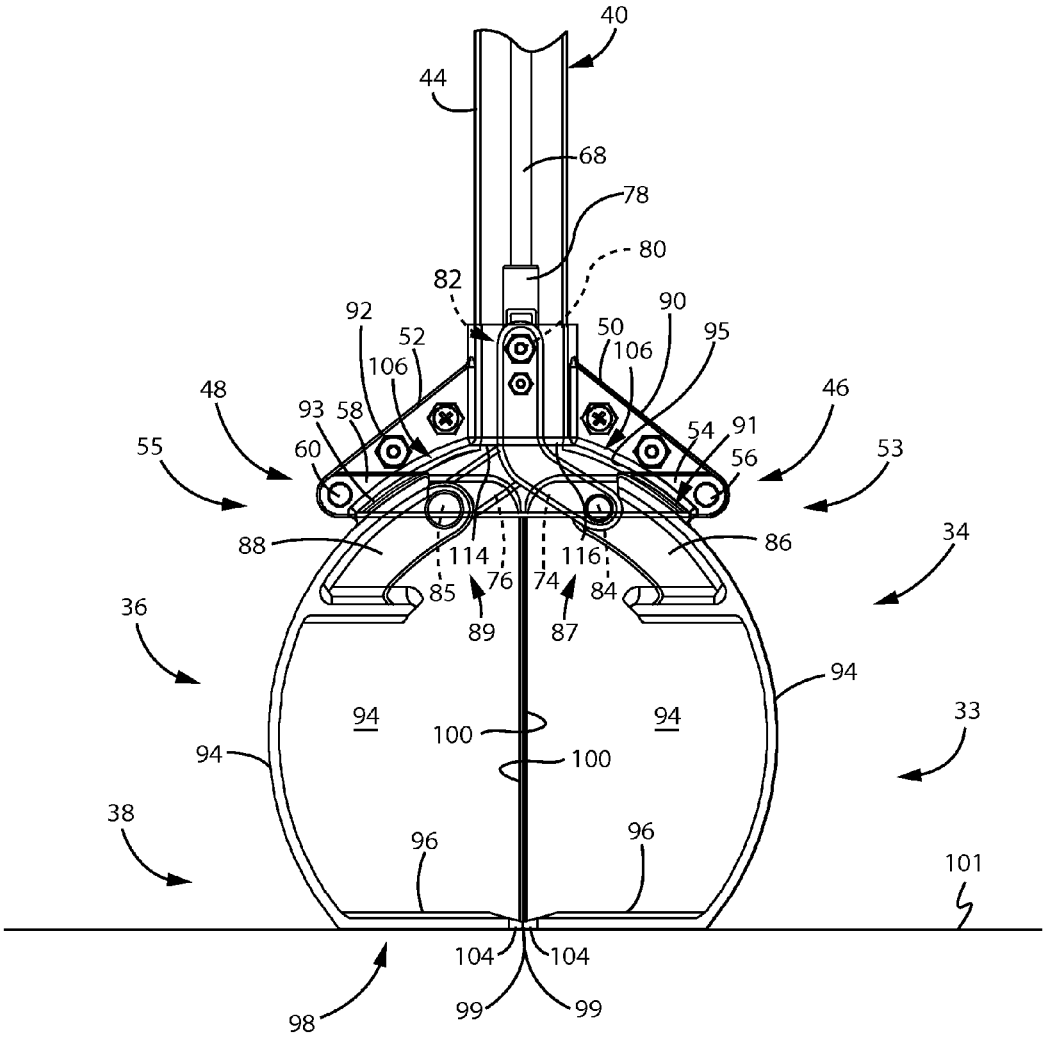
FIG. 12 is an enlarged side elevation of the scooper head of the scooper of FIG. 11.

Although not shown in FIGS. 1-10, the scooper 32 can include a manually operated lock, such as the trigger lock 112 shown in FIG. 11, configured to enable a user to releasably lock one or both scoop jaws 34, 36 in a desired open or closed position such as by locking the trigger 70 in place. In this regard, where a scooper 32 in accordance with the present invention is configured to urge or bias one or both jaws 34, 36 to an open position, e.g., an "always open" scoop jaw configuration, such a lock, e.g., trigger lock 112, can releasably retain one or both jaws 34, 36 in the closed position until the lock 112 is disengaged. Where a scooper 32 constructed in accordance with the present invention is of an "always open" configuration and has scoop jaws 34, 36 with generally flat or planar bottom walls 96 upon which the scooper 32 can be uprightly stood, such a lock, e.g., trigger lock 112, enables one or both jaws 34, 36 to be releasably locked in their closed position thereby enabling the scooper 32 to be stood uprightly when not in use.

During use and operation of the scooper 32, a user grasps the handle 42 to move the scooper 32 into a desired position relative to an object 103 on the ground, floor or another surface 101 disposed below the user that the user wishes to pick up. Where one or both scoop jaws 34, 36 have been locked, such as during storage of the scooper 32, the lock is released enabling the scooper 32 to be used. When at least one of the jaws 34, 36 have been manipulated by the user so the teeth 104 of one of the jaws 34, 36 is disposed alongside the object, the user manipulates the trigger 70 of the handle 42 in a manner that moves at least one of the jaws 34, 36 relative to the other one of the jaws 34, 36 to scoop the object up and capture the object in the chamber 38 formed when the jaws 34, 36 are closed.

Where the scooper 32 is of an "always open" configuration, releasing the lock, e.g., trigger lock 112 (FIG. 11), opens the scooper 32 by enabling at least one of the scoop jaws 34, 36 to move relative to the other one of the scoop jaws 34, 36 to an open position, During scooping up of the object, squeezing of the trigger 70 of the handle 42 causes each movable jaw 34, 36 to close. When closed, each object 103 scooped up is releasably retained in the chamber 38 formed by the closed jaws 34, 36 enabling each object 103 to be easily, securely and safely deposited elsewhere in a sanitary manner.

Where the scooper 32 is equipped with a lock, e.g., trigger lock 112 (FIG. 11), the scoop jaws 34, 36 can be releasably locked closed helping to ensure that any object 103 within the chamber 38 will not be inadvertently dropped or discharged until a user of the scooper 32 desires to do so. Where not equipped with a lock, a user can simply continue to squeeze the trigger 70 to keep the jaws 34, 36 closed until the chamber 38 is maneuvered over a desired location, such as a bag, refuse container or the like. Once maneuvered over the desired location, the trigger 70 can be released to cause one or both jaws 34, 36 to open releasing the object(s) 103 from the chamber 38 into the bag, refuse container or the like.

A scooper 32 constructed in accordance with the present invention is well suited for outdoor use for picking up dog poop, for grasping and picking up objects 103 on the floor or ground 101, as well as for indoor use in removing litter clumps and turds from litter boxes. Where the scooper 32 is intended for use in scooping fecal matter, turds, clumps and the like from granular litter in a litter box, the sidewall 94 and/or bottom wall 96 of one or both scoop jaws 34, 36 can be of perforate construction.

Understandably, the present invention has been described above in terms of one or more preferred embodiments and methods. It is recognized that various alternatives and modifications may be made to these embodiments and methods that are within the scope of the claimed invention. Various alternatives are contemplated as being within the scope of the claimed invention. It is also to be understood that, although the foregoing description and drawings describe and illustrate in detail one or more preferred embodiments of the present invention, to those skilled in the art to which the present invention relates, the present disclosure will suggest many modifications and constructions, as well as widely differing embodiments and applications without thereby departing from the spirit and scope of the claims set forth below.

It is claimed:

1. A scooper comprising:

a frame comprised of a tube;

a pair of generally opposed scoop jaws in operable cooperation with the frame, one of the scoop jaws pivotably movable relative to the other one of the scoop jaws forming an object-retaining chamber when the scoop jaws are disposed in a closed position;

a manipulable scoop jaw actuator carried by the frame;

a scoop jaw link in operable cooperation with the manipulable scoop jaw actuator, the scoop jaw link having one portion slidably telescopically received in the tube and another portion extending outwardly from the tube that is pivotally connected to the one of the scoop jaws that is pivotally movable relative to the other one of the scoop jaws; and wherein the scoop jaw link is slidably guided by the tube by riding along a portion of the tube thereby pivotably moving the one of the scoop jaws toward the other one of the scoop jaws toward the closed position when the scoop jaw actuator is manipulated to dispose the scoop jaws in the closed position.

2. The scooper of claim 1, further comprising a skirt extending outwardly from the frame that enshrouds at least a portion of the object-retaining chamber formed when the scoop jaws are disposed in the closed position, the skirt comprising a scoop jaw pivot anchor to which the one of the scoop jaws pivotably movable relative to the other one of the scoop jaws is pivotally attached.

3. The scooper of claim 1, further comprising a frustum-shaped skirt extending radially outwardly from the frame and generally downwardly toward the scoop jaws overlying at least a portion of each scoop jaw disposed adjacent the frame, the skirt comprising a pair of elongate scoop jaw pivot arms extending oppositely outwardly from the frame away from the frame toward the scoop jaws with one of the scoop jaws pivotally attached to one of the scoop jaw pivot arms and the other one of the scoop jaws pivotally attached to the other one of the scoop jaw pivot arms.

4. The scooper of claim 3, wherein there are a pair of the pivotable scoop jaw links in operable cooperation with the manipulable scoop jaw actuator, each pivotable scoop jaw link having one portion slidably telescopically received in the tube and another portion extending outwardly from the tube that is pivotally connected to a corresponding one of the scoop jaws.

5. The scooper of claim 4, wherein the object-retaining chamber formed by the closed scoop jaws is generally bulbous or generally spherical, wherein the skirt has a frusto-conical shape substantially complementary to the shape of a top portion of the object-retaining chamber formed by the closed scoop jaws, and wherein the top portion of the object-retaining chamber formed by the closed scoop jaws is substantially completely covered by the skirt when the scoop jaws are closed.

6. The scooper of claim 1, wherein the scoop jaws form a substantially completely enclosed object-retaining chamber when the scoop jaws are closed.

7. The scooper of claim 1, wherein the object-retaining chamber formed by the closed scoop jaws is generally bulbous or generally spherical.

8. The scooper of claim 7, further comprising a skirt extending outwardly from the frame that enshrouds a portion of the object-retaining chamber.

9. The scooper of claim 7, wherein the object-retaining chamber formed by the closed scoop jaws has a substantially flat or planar bottom upon which the scooper can generally uprightly rest on a generally flat or planar surface.

10. The scooper of claim 9, wherein at least one of the scoop jaws is biased relative to the other one of the scoop jaws in an open position disposed from the closed position, and wherein the scoop jaw actuator is manipulated by a user of the scooper to pivotably move the one of the scoop jaws toward the other one of the scoop jaws to dispose the scoop jaws in the closed position.

11. The scooper of claim 1, wherein the scoop jaws are biased in an open position disposed from the closed position, and wherein each one of the scoop jaws is pivotably moved relative to the frame toward the other one of the scoop jaws to dispose the scoop jaws in the closed position when the scoop jaw actuator is manipulated by a user of the scooper.

12. The scooper of claim 1, wherein the manipulable scoop jaw actuator is operatively connected to a scoop jaw actuator assembly that is pivotably connected to the pivotable scoop jaw link.

13. The scooper of claim 12, wherein the scoop jaw actuator assembly comprises an elongate connecting link received within the tube that is pivotally connected to the scoop jaw link with the scoop jaw link pivotally connected at one end to the connecting link and pivotally connected at an opposite end to the one of the scoop jaws that is pivotably movable relative to the other one of the scoop jaws.

14. The scooper of claim 13, wherein each one of the scoop jaws (i) is pivotally connected to the frame, and (ii) is pivotally connected to a corresponding one of a pair of the scoop jaw links, and wherein the pair of scoop jaw links are slidably guided by the tube by riding along a portion of the tube to decrease an acute included angle between the scoop jaw links during closing of the scoop jaws.

15. The scooper of claim 1, wherein the frame is comprised of a pair of oppositely outwardly extending pivot anchors disposed exteriorly of the scoop jaws that define a cradle that supports the scoop jaws when the scoop jaws are disposed in a closed position with one of the scoop jaws pivotally connected to one of the pivot anchors and the other one of the scoop jaws pivotally connected to the other one of the pivot anchors.

16. The scooper of claim 1, wherein the manipulable scoop jaw actuator comprises a handle that is operatively connected by a scoop jaw actuator assembly to the scoop jaw link, the scoop jaw actuator assembly slidably guided by the frame during movement of one of the scoop jaws relative to the other one of the scoop jaws between the closed position and an open position disposed from the closed position when the handle is manipulated by a user of the scooper.

17. The scooper of claim 1, wherein frame is comprised of an elongate tube and wherein the scoop jaw actuator is operatively connected to a scoop jaw actuator assembly comprised of an elongate connecting link received within the tube that is pivotally connected by a pair of the scoop jaw links to a corresponding one of the scoop jaws with each one of the scoop jaw links pivotally connected at one end to the elongate connecting link and pivotally connected at an opposite end to a corresponding one of the scoop jaws.

18. The scooper of claim 17, wherein the pair of scoop jaw links are slidably guided by the tube of the frame by riding along a portion of the tube decreasing an acute included angle between the scoop jaw links during closing of the scoop jaws.

19. The scooper of claim 1 wherein the scoop jaw link is of non-straight construction.

20. The scooper of claim 19 wherein the scoop jaw link is curved.

21. A scooper comprising:

a handle;

a frame comprised of an elongate tube carrying the handle, the frame having a pair of scoop jaw pivot anchors extending generally oppositely outwardly therefrom;

a pair of generally opposed scoop jaws in operable cooperation with the frame, each one of the scoop jaws movable relative to the other one of the scoop jaws forming an object-retaining chamber when the scoop jaws are disposed in a closed position, each one of the scoop jaws pivotally connected to a corresponding one of the jaw pivot anchors of the frame; and a scoop jaw actuator assembly operatively connected to the handle, the scoop jaw actuator assembly comprising an elongate connector received within the tube that is pivotally connected by a pair of scoop jaw links to the scoop jaws with each one of the scoop jaw links having (i) one portion received within the tube and operatively pivotally connected to the elongate connector, and (ii) another portion extending outwardly of the tube and pivotally connected to a corresponding one of the scoop jaws; and a skirt extending outwardly from the frame adjacent to the jaw pivot anchors, the skirt covering a top portion of the object-retaining chamber formed by the scoop jaws when the scoop jaws are disposed in the closed position; and wherein each one of the jaw pivot anchors is pivotally connected to a corresponding one of the scoop jaws exteriorly thereof, and wherein each one of the scoop jaw links is pivotally connected to a corresponding one of the scoop jaws interiorly thereof.

22. The scooper of claim 21, wherein the skirt comprises a downwardly facing bowl-shaped skirt covering the top portion of the scoop jaws.

23. The scooper of claim 21, wherein the elongate connector comprises an elongate connecting link and each one of the scoop jaw links has an edge that rides along a scoop jaw link guide adjacent one end the tube thereby slidably guiding each one of the scoop jaw links toward one another pivoting each one of the scoop jaws toward one another during closing of the scoop jaws.

24. The scooper of claim 23 wherein the scoop jaw link guide comprises a shoulder disposed at or adjacent an end of the frame proximal to the scoop jaws.

25. The scooper of claim 24 wherein the shoulder of the scoop jaw link guide is formed of an end of the tube.

26. The scooper of claim 24 wherein each one of the scoop jaw links is of elongate non-straight construction.

27. The scooper of claim 26 wherein each one of the scoop jaw links is curved.

28. The scooper of claim 21, wherein the elongate connector comprises an elongate rod slidably telescopically received within the tube, and wherein each one of the scoop jaw links is elongate and has (i) the one portion slidably telescopically received within the tube, and (ii) an elongate longitudinally extending side edge facing outwardly toward the tube that rides along part of the tube during closing of the scoop jaws.

29. The scooper of claim 28 wherein the outwardly facing longitudinally extending side edge of each scoop jaw link is slidably guided by an end of the tube disposed adjacent the scoop jaws during closing of the scoop jaws.

30. The scooper of claim 28 wherein the longitudinally extending side edge of each one of the scoop jaw links is of non-straight construction.

31. The scooper of claim 30 wherein the longitudinally extending side edge of each one of the scoop jaw links is curved.

32. The scooper of claim 21 wherein each one of the scoop jaw links is of elongate non-straight construction.

33. The scooper of claim 32 wherein each one of the scoop jaw links is curved.

34. A scooper comprising:

a handle;

a frame comprised of an elongate tube carrying the handle, the frame having a pair of pivot anchors extending oppositely outwardly from the tube;

a pair of generally opposed scoop jaws in operable cooperation with the frame, each one of the scoop jaws movable relative to the other one of the scoop jaws forming an object-retaining chamber when the scoop jaws are disposed in a closed position, each one of the scoop jaws pivotally connected to a corresponding one of the pivot anchors; and a scoop jaw actuator assembly operatively connected to the handle, the scoop jaw actuator assembly comprising an elongate connecting link slidably telescopically received within the tube that is pivotally connected by a pair of scoop jaw links to the scoop jaws with each one of the scoop jaw links pivotally connected at one end to the elongate connecting link and pivotally connected at an opposite end to a corresponding one of the scoop jaws; and wherein each one of the scoop jaw links is slidably guided by the tube of the frame adjacent an end of the frame proximal the scoop jaws during movement of the scoop jaws from an open position toward the closed position.

35. The scooper of claim 34 wherein the handle has a trigger that displaces the elongate connecting link relative to the tube away from the scoop jaws closing the scoop jaws when the trigger is squeezed.

36. The scooper of claim 34 wherein each one of the scoop jaw links has (i) one portion slidably telescopically received within the tube, (ii) another portion extending outwardly from the tube, and (iii) a side edge that rides along an end of the tube when slidably guided by the tube of the frame.

37. The scooper of claim 34 wherein each one of the scoop jaw links is pivotable relative to each other and the connecting link defining an acute included angle between the scoop jaw links that decreases during closing of the scoop jaws.

38. The scooper of claim 34 wherein each one of the scoop jaw links is of elongate non-straight construction.

39. The scooper of claim 38 wherein each one of the scoop jaw links is curved.

* * * * *